US008782942B1

(12) United States Patent
Bentley

(10) Patent No.: US 8,782,942 B1
(45) Date of Patent: Jul. 22, 2014

(54) FOREND WITH SIGHT TUNNEL

(71) Applicant: Krow Innovation, LLC, Nampa, ID (US)

(72) Inventor: James K. Bentley, Eagle, ID (US)

(73) Assignee: Krow Innovation, LLC, Nampa, ID (US)

( * ) Notice: Subject to any disclaimer, the term of this patent is extended or adjusted under 35 U.S.C. 154(b) by 0 days.

(21) Appl. No.: 14/037,188

(22) Filed: Sep. 25, 2013

(51) Int. Cl.
*F41C 23/00* (2006.01)

(52) U.S. Cl.
USPC ..... 42/75.01; 42/71.01

(58) Field of Classification Search
CPC ..... F41C 23/16; F41C 7/02; F41C 7/025
USPC ..... 42/90, 71.01, 75.01
See application file for complete search history.

(56) References Cited

U.S. PATENT DOCUMENTS 2,795,048 A * 6/1957 Seymour et al. ..... 42/148
3,555,687 A * 1/1971 Joseph ..... 42/124
4,418,487 A * 12/1983 Strahan ..... 42/125
4,502,238 A * 3/1985 Farrar et al. ..... 42/72
4,837,961 A * 6/1989 Keenan ..... 42/72
5,027,542 A * 7/1991 Simonetti ..... 42/72
5,068,992 A * 12/1991 Velezis et al. ..... 42/72
5,727,346 A * 3/1998 Lazzarini et al. ..... 42/146
5,913,669 A * 6/1999 Hansen et al. ..... 42/146
6,782,652 B1 * 8/2004 Erickson ..... 42/143
8,393,108 B1 * 3/2013 Wilson ..... 42/111
8,522,469 B2 * 9/2013 Baker ..... 42/90
2007/0137087 A1 * 6/2007 Florea et al. ..... 42/90
2013/0276342 A1 * 10/2013 Chvala ..... 42/90

OTHER PUBLICATIONS

Black Aces Tactical Remington 870 Shotgun Rail. <http://web.archive.org/web/20120626023605/http://www.gunsamerica.com/blog/black-aces-tactical-remington-870-shotgun-rail>. Jun. 26, 2012.*

* cited by examiner

*Primary Examiner* — Gabriel Klein
(74) *Attorney, Agent, or Firm* — Parsons Behle & Latimer

(57) ABSTRACT

A forend for a firearm that includes a sight tunnel through the forend. The forend may be adapted to actuate a tube magazine of a shotgun to insert a shell from the tube magazine into a receiver of the shotgun. The forend may include an integral heat shield to protect a shooter from heat off of the barrel of the firearm. The forend may include a rail, such as an accessory rail, such as a Picatinny rail, that permits the attachment of an accessory to the top of the forend. The sight tunnel through the forend is below the accessory rail and permits the attachment of a light accessory to light up a front sight and/or a target. The front sight may be viewed through the sight tunnel by an operator of a firearm using the forend.

12 Claims, 6 Drawing Sheets

FOREND WITH SIGHT TUNNEL

BACKGROUND

1. Field of the Disclosure

The embodiments described herein relate to a forend for a firearm that includes a sight tunnel that permits the shooter to view a front sight through the forend. The forend may be adapted to be positioned on a shotgun and moved to insert a shell from a tube magazine into a receiver of the shotgun. The forend may include an integral heat shield positioned over the barrel of the firearm. The forend may include a rail positioned above the sight tunnel to permit the attachment of an accessory, such as a light that may be used to light up the front sight and/or to light up a target.

2. Description of the Related Art

FIG. 1 shows a prior art semi-auto shotgun 5 that includes a butt stock 35 connected to one end of a receiver 40. A barrel 20 and a magazine tube 10 are connected to the other end of the receiver 40. A front bead sight 50 is positioned on top of the barrel 20 at the muzzle end of the barrel 20. An operator of the shotgun 5 may be able to view a potential target along a sight path (shown as arrow 70) along the top of the receiver 40 and barrel 20 to line up the potential target using the sight 50 at the end of the barrel 20. The movement of a forend/pump 30 along the magazine tube 10 may be used to actuate the magazine tube 10 to insert a shell into the receiver 40 as would be recognized by one of ordinary skill in the art.

The semi-auto shotgun 5 may include a heat shield 60 positioned over the entire length of a significant portion of the length of the barrel 20. Heat shields 60 may be used to protect the user from the heat given off from the barrel 20 due to repeated rapid discharge of the shotgun and/or to change the appearance of the shotgun 5 to have a more tactical nature. Heat shields 60 may be an after-market addition to a firearm and as a result may difficult for a user to install onto the firearm. In addition to being difficult to install, the recoil of the firearm may cause the heat shield 60 to become loose and/or change the handling of the firearm. The long length of the heat shield 60 may cause a change in the recoil of the firearm.

The addition of a low profile heat shield 60 may not affect the sight path 70 of a traditional semi-auto shotgun 5. However, the addition of other accessories, such as a light, to the top of the shotgun may potentially block the sight path 70 from the receiver 40 to the front sight 50. As a result any such accessories may be attached beneath the shotgun 5, which may not be optimal. For example, a light positioned below the shotgun 5 will not light up the front sight 50, which may be preferred.

SUMMARY

The present disclosure is directed to forend for a firearm that overcomes some of the problems and disadvantages discussed above.

One embodiment is a firearm forend having a top surface, bottom surface, first side wall connected to the top and bottom surfaces, and a second side wall connected to the top and bottom surfaces. The forend has a first end, a second end, and a first aperture extending from the first end to the second end. The first aperture is between the top surface and bottom surface and is configured for the insertion of a magazine tube. The forend has a second aperture above the first aperture that extends from the first end to the second end of the forend. The second aperture is configured for the insertion of a barrel of a shotgun. The forend has a sight tunnel above the second aperture that extends from the first end to the second end of the forend. The sight tunnel is beneath the top surface of the forend.

The forend may be adapted to actuate the magazine tube by movement of the forend along the magazine tube. The top surface of the forend may comprise a heat shield. The top surface of the forend may comprise an accessory rail. The forend may include a handle connected to one of the side walls. The forend may include at least one opening in each of the side walls. The forend may include a grip covering at least a portion of the bottom surface, first side wall, and second side wall. The sight tunnel may extend from a top portion of the second aperture.

One embodiment is a shot gun comprising a receiver, a barrel with a first end of the barrel being connected to the receiver. A sight is positioned at the second end of the barrel. The shotgun comprises a magazine tube connected to the receiver and a forend positioned around both the barrel and the magazine tube. The forend has a sight tunnel that provides a sight path from the receiver to the sight.

The movement of the forend may inject a shell from the magazine tube into the receiver. The forend of the shotgun may include a plurality of projects that extend from the bottom surface of the forend. The shotgun may include an accessory rail attached to a top surface of the forend. The shotgun may include a light selectively connected to the accessory rail attached to the top surface of the forend. The shotgun may include a heat shield positioned above the barrel. The shotgun may include a second accessory rail connected to the forend.

One embodiment is a firearm comprising a receiver, a barrel, and a forend selectively connected to the barrel. The first end of the barrel is connected to the receiver and a front sight is positioned at the second end of the barrel. The forend is positioned around the barrel. A sight tunnel in the forend provides a sight path from the receiver to the front sight.

The firearm may include a heat shield positioned above the barrel. The firearm may comprise an accessory rail connected to a top surface of the forend. The firearm may comprise an accessory selectively connected to the accessory rail. The accessory may be a light.

Figure 1:
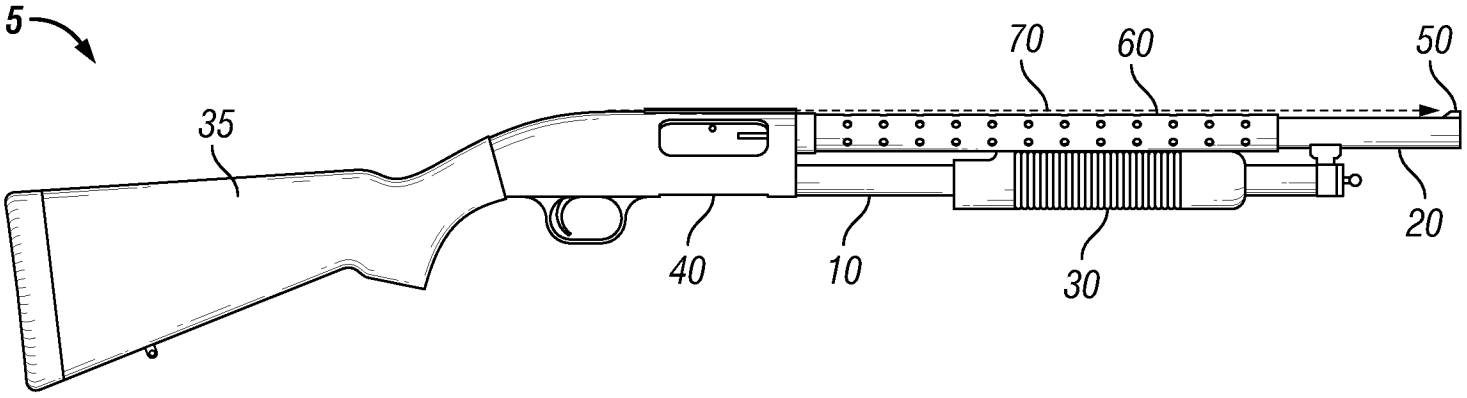
FIG. 1 (Prior Art)
FIG. 1 is a prior art semi-auto shotgun having a normal sight path over the barrel and/or heat shield.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 2:
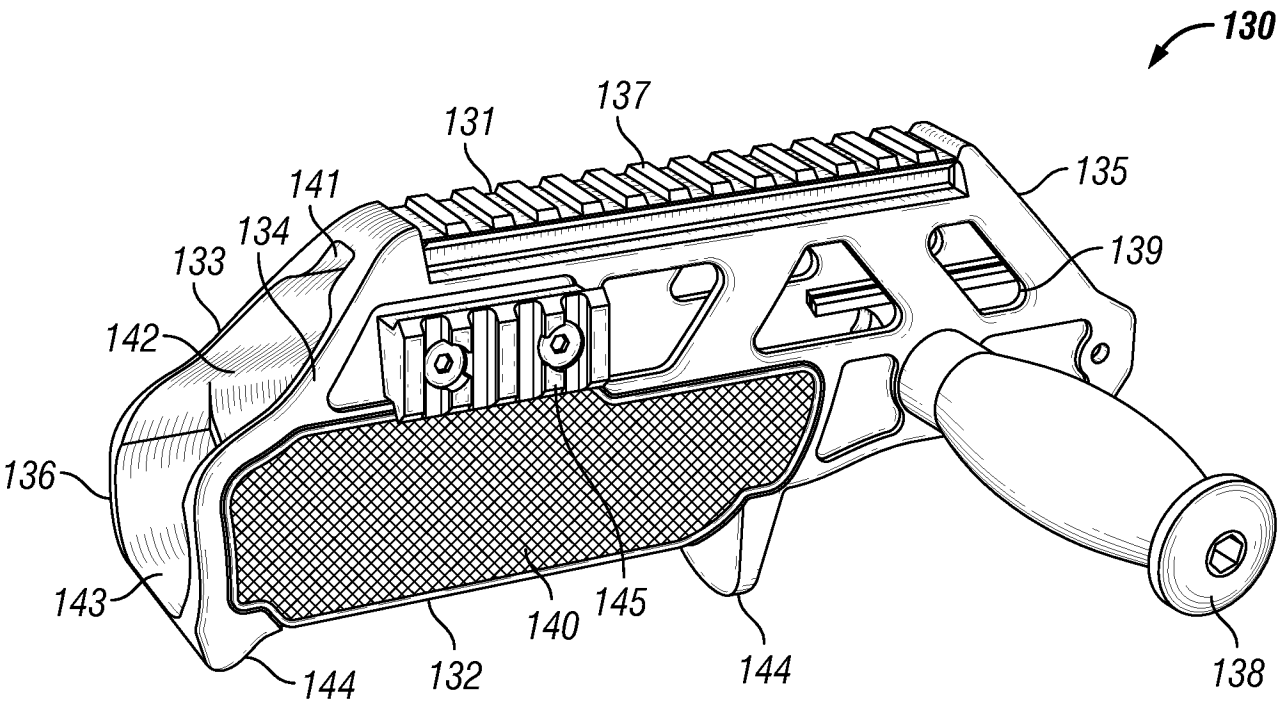
FIG. 2 shows one embodiment of a forend having a sight tunnel through the forend.

FIG. 2 shows one embodiment of a forend 130 that includes a sight tunnel 141. The top surface 131 of the forend may include an integrated accessory rail/heat shield 137. Alternatively, an accessory rail may be separate component attached to the top surface that includes a heat shield via various fasteners. The heat shield 137 provides a shield against heat off of a barrel while the accessory rail 137 permits the selective attachment of an accessory to the forend 130 above the sight path of a firearm. The heat shield and accessory rail may be separate components of the forend 130 as would be appreciated by one of ordinary skill in the art having the benefit of this disclosure. The forend 130 includes a second accessory rail 145 on one of the side walls 133 and 134 of the forend 130. A second accessory rail 145 may be located on each side wall 133 and 134 to permit the attachment of multiple accessories to the forend.

The forend 130 includes a first side 133 and a second side 134 connected to the top surface 131 and the bottom surface 132. The forend 130 may include a grip 140 that may cover portions of the sides 133 and 134 as well as the bottom 132. The grip 140 may comprise various surface patterns that aid in the gripping of the forend 130 by an operator as would be appreciated by one of ordinary skill in the art having the benefit of this disclosure.

The embodiment of the forend 130 shown in FIG. 2 is adapted to be installed onto a shotgun having a barrel and a magazine tube. However, the forend 130 having a sight tunnel 141 may be applicable to the barrel of various firearms not having a magazine tube, such as rifles and/or long guns. The forend 130 may include a first or lower aperture/opening 143 that extends from a first end 135 to a second end 136 of the forend 130. The lower opening 143 may be adapted to allow the insertion of a magazine tube of a shotgun. The forend 130 may be adapted to actuate the operation of a magazine tube upon back and forth movement along the magazine tube as would be appreciated by one of ordinary skill in the art having the benefit of this disclosure. The actuation of a magazine tube to insert a shell into a receiver of a shotgun due to the cycling of a pump or forend along a magazine tube is well known in the art and as such will not be described in detail herein. The forend 130 may include a handle 138 that may be gripped by the user to hold the firearm onto which the forend is selectively installed and/or may be used to cycle the forend 130 along the magazine tube. Alternatively, the forend 130 may include a grip 140 and/or protrusions 144 that may aid in the gripping of the forend 130.

The forend 130 may include a second or upper aperture/opening 142 that also extends from the first end 135 to the second end 136 of the forend 130. The upper opening 142 may be adapted to allow the insertion of barrel of a firearm such as a barrel of a shotgun. Each side 133 and 134 may include a plurality of openings 139. The sight tunnel 141 of the forend 130 may be a third aperture that extends from the first end 135 to the second end 136 of the forend 130. Alternatively, the sight tunnel 141 may extend between the first and second ends 135 and 136, but instead of being a third distinct aperture, may be an opening that extends upwards from the top portion of the upper opening 142 as shown in FIG. 2. The sight tunnel 141 permits a sight path from a receiver through the forend 130 to a front sight at the end of a barrel as will be described in more detail in regards to FIGS. 3-5.

Figure 3:
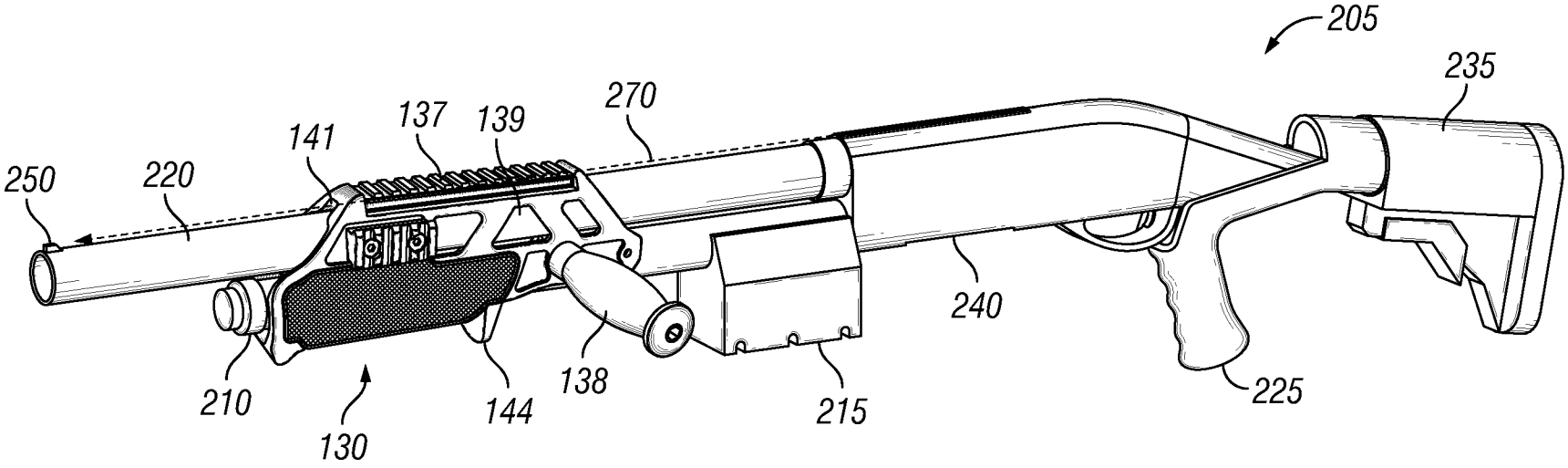
FIG. 3 is a shows one embodiment of a forend having a sight tunnel through the forend, the forend being installed onto a magazine fed shotgun.

FIG. 3 shows a forend 130 having a sight tunnel 141 installed onto a firearm 205. The firearm 205 may be a magazine fed shotgun that includes a magazine well 215 for engagement of a magazine (not shown) with the receiver 240. The firearm 205 may include a pistol grip 225 and/or a butt stock 235 connected to the receiver 240. The forend 130 may be adapted to be installed around a barrel 220 and a magazine tube 210 even though the magazine tube 210 may not be used to feed shells to the receiver 240. The firearm 205 may not include a magazine tube 210 and as such the forend 130 having a sight tunnel 141 may be adapted to only be installed onto a barrel 220 of the firearm 205 while still providing an unobstructed sight path (shown as arrow 270) from the receiver 240 of the firearm through the sight tunnel 141 to a front sight 250 on the end of the barrel 220. The forend 130 may include a handle 138 to grip the firearm even through the forend 130 may not be adapted to move along a magazine tube 210 to feed a shell into the receiver 240. The forend 130 may include an accessory rail 137, such as a Picatinny rail or a Weaver rail, to permit the attachment of an accessory to the forend 130 above the sight tunnel 141. The accessory rail 137 may also serve as a heat shield in regards to heat given off from the barrel 220 of the firearm 205.

Figure 4:
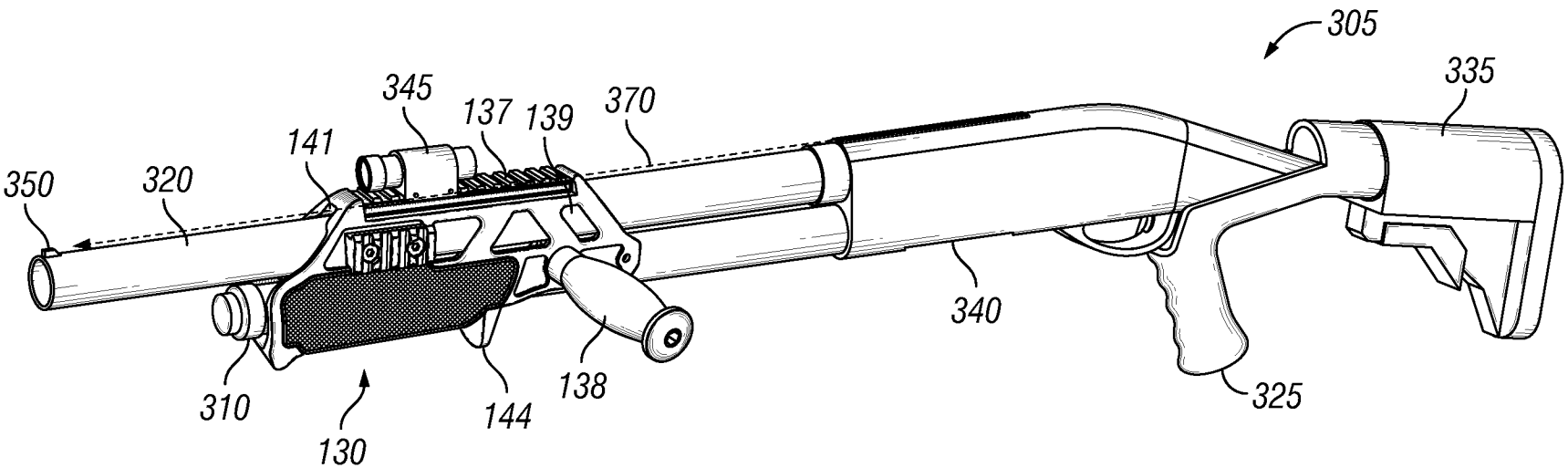
FIG. 4 shows a one embodiment of a forend having a sight tunnel in a forward position on a semi-auto shotgun.
Figure 5:
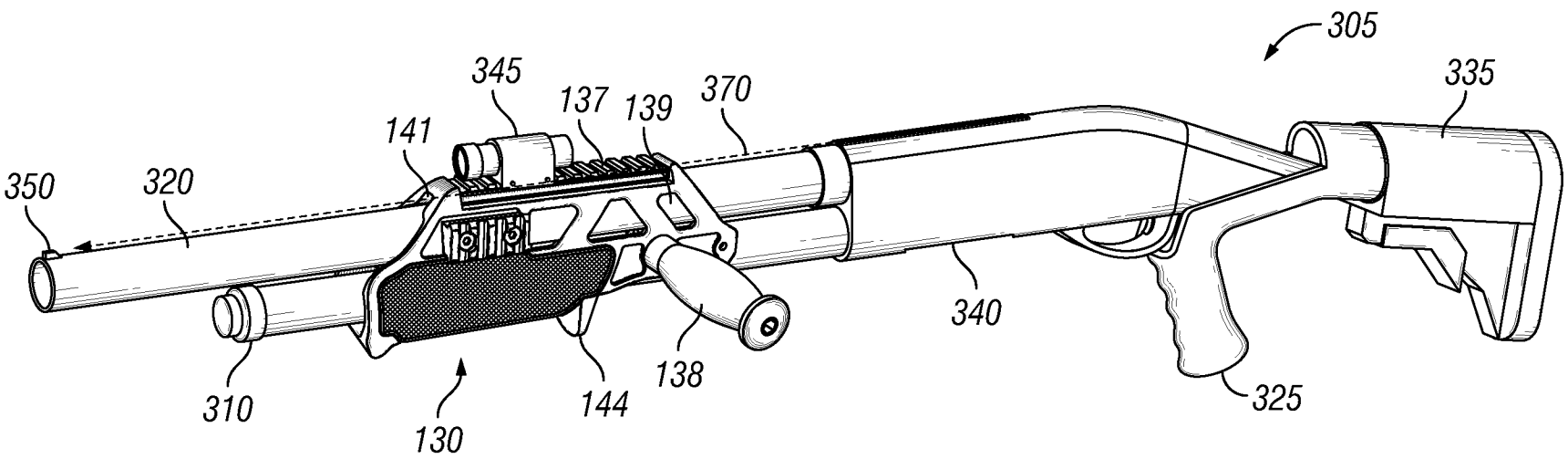
FIG. 5 shows a one embodiment of a forend having a sight tunnel in a rearward position on a semi-auto shotgun.

FIG. 4 shows an embodiment of a forend 130 having a sight tunnel 141 installed onto a semi-auto shotgun 305. The shotgun 305 may include a butt stock 335 and/or a pistol grip 325 connected to the receiver 340. The forend 130 having a sight tunnel 141 is installed over the barrel 320 and magazine tube 310 of the shotgun 305. FIG. 4 shows the forend 130 in a forward position and FIG. 5 shows the forend 130 in a rearward position cause the insertion of a shell into the receiver 340 from the magazine tube 310 as would be appreciated by one of ordinary skill in the art having the benefit of this disclosure. The forend 130 may include a handle 138, grip portion 140, and/or protrusions 144 that may aid an operator in the manipulation of the forend 130 along the magazine tube 310 to cycle shells into the receiver 340 from the magazine tube 310. An accessory, such as a light 345, may be selectively connected to the forend 130 via a rail 137 above the sight tunnel 141. The sight tunnel 141 and rail 137 positioned above the sight tunnel 141 permits the attachment of an accessory to the firearm 305 without obstructing the sight path (shown as arrow 370) from the receiver 340 to the front sight 350 on the muzzle end of the barrel 320. The use of a light 345 connected to the rail 137 may beneficially light up the front sight 350 while permitting an operator to view the front sight 350 through the sight tunnel 141 of the forend 130.

Figure 6:
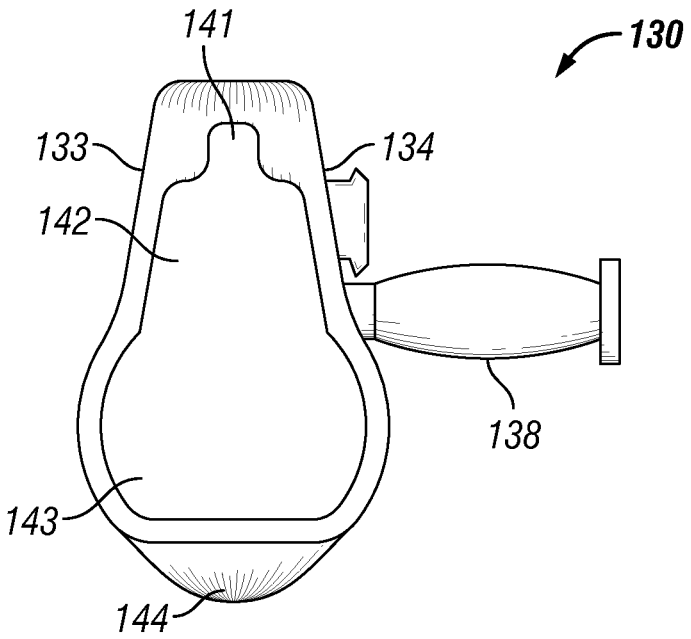
FIG. 6 shows an end view of a sight tunnel through one embodiment of a forend having a sight tunnel.

FIG. 6 shows an end view of an embodiment of the forend 130 with the sight tunnel 141 extending through the entire forend 130. The sight tunnel 141 permits the unobstructed view of the front sight and/or a potential target while the forend 130 also provides a heat shield over the barrel of the firearm. The forend end 130 may include a single opening that has an upper portion 141 that is a sight tunnel, a middle portion 142 adapted to receive the barrel of a firearm, and a bottom portion 143 adapted to receive a magazine tube of a firearm. Alternatively, the forend may include three separate openings to receive a barrel, a magazine tube, and provide a sight tunnel through the forend. A grip portion 140 may extend along the bottom of the forend 130 and extend up a portion of the sides 133 and 134 of the forend 130. A handle 138 may be connected to one of the sides 133 or 134 of the forend 130.

A forend 130 having a sight tunnel 141 may be adapted to receive a barrel of a firearm that does not include a magazine tube. The forend may include a single opening with an upper portion being a sight tunnel 141 and the lower portion adapted to receive a barrel of the firearm. Alternatively, the forend 130 may include two separate openings with the upper opening being a sight tunnel 141 and the lower opening being adapted to receive a barrel of a firearm.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof

TABLE OF REFERENCE NUMERALS FOR FIGS. 1-6

5 shotgun
10 magazine tube
20 barrel
30 pump forend
40 receiver
50 front sight
60 heat shield
70 sight path
130 forend
131 top surface of forend
132 bottom surface of forend
133 first side of forend
134 second side of forend
135 first end of forend
136 second end of forend
137 integrated heat shield/accessory rail
138 forend handle
139 openings in side of forend
140 grip on forend
141 sight tunnel through forend
142 barrel opening/aperture in forend
143 magazine tube opening/aperture in forend
144 protrusion on bottom of forend
145 second accessory rail
205 magazine fed shotgun
210 magazine tube
215 magazine well
220 barrel
225 pistol grip
235 butt stock
240 receiver
250 front sight
270 sight path
305 shotgun
310 magazine tube
320 barrel
325 pistol grip
335 butt stock
340 receiver
345 light
350 front sight
370 sight path

What is claimed is:

1. A firearm forend, the forend comprising:

a top surface, the top surface comprising a heat shield and an accessory rail configured to permit selective attachment of various firearm accessories;

a bottom surface;

a first side wall connected to the top and bottom surfaces;

a second side wall connected to the top and bottom surfaces;

a first end;

a second end;

a first aperture extending from the first end to the second end, the first aperture being between the top surface and bottom surface and being configured for the insertion of a magazine tube;

a second aperture above the first aperture extending from the first end to the second end, the second aperture configured for the insertion of a barrel of a shotgun; and a sight tunnel above the second aperture extending from the first end to the second end, the sight tunnel being beneath the top surface;

wherein the forend is adapted to inject a shell from the magazine tube into a receiver of the shotgun by movement of the forend.

2. The firearm forend of claim 1 further comprising a handle connected to the first side wall.

3. The firearm forend of claim 2 further comprising at least one opening in each of the first and second side walls.

4. The firearm forend of claim 3 further comprising a grip covering at least a portion of the bottom surface, first side wall, and second side wall.

5. The firearm forend of claim 1, wherein the sight tunnel extends from a top portion of the second aperture.

6. The firearm forend of claim 1, wherein the accessory rail is a Picatinny rail or a Weaver rail.

7. A shotgun, the shotgun comprising:

a receiver;

a barrel, a first end of the barrel being connected to the receiver, a sight positioned at a second end of the barrel;

a magazine tube connected to the receiver below the barrel; and a forend, the forend positioned around both the barrel and the magazine tube, a forend, the forend comprising a top surface having an accessory rail configured to permit selective attachment of various firearm accessories, a bottom surface, a first side wall connected to the top and bottom surfaces, a second side wall connected to the top and bottom surfaces, a first end, and a second end having a sight tunnel that extends from the first end to the second end and beneath the top surface and above the barrel, wherein the sight tunnel provides a sight path from the receiver to the sight and wherein movement of the forend injects a shell from the magazine tube into the receiver.

8. The shotgun of claim 7 the forend further comprising a plurality of projections extending from the bottom surface of the forend.

9. The shotgun of claim 7 further comprising a light selectively connected to the accessory rail.

10. The shotgun of claim 7 the forend further comprising a heat shield positioned above the barrel.

11. The shotgun of claim 7 further comprising a second accessory rail attached to the forend.

12. The shotgun of claim 7, wherein the accessory rail is a Picatinny rail or a Weaver rail.

* * * * *

UNITED STATES PATENT AND TRADEMARK OFFICE

CERTIFICATE OF CORRECTION

PATENT NO. : 8,782,942 B1
APPLICATION NO. : 14/037188
DATED : July 22, 2014
INVENTOR(S) : James K. Bentley It is certified that error appears in the above-identified patent and that said Letters Patent is hereby corrected as shown below:

In the Claims

Claim 7 should read

7. A shotgun, the shotgun comprising:
a receiver;
a barrel, a first end of the barrel being connected to the receiver, a sight positioned at a second end of the barrel;
a magazine tube connected to the receiver below the barrel; and
a forend, the forend comprising a top surface having an accessory rail configured to permit selective attachment of various firearm accessories, a bottom surface, a first side wall connected to the top and bottom surfaces, a second side wall connected to the top and bottom surfaces, a first end, and a second end positioned around both the barrel and the magazine tube, the forend having a sight tunnel, that extends from the first end to the second end and beneath the top surface and above the barrel wherein the sight tunnel provides a sight path from the receiver to the sight and wherein movement of the forend injects a shell from the magazine tube into the receiver; and
an accessory rail attached to a top surface of the forend.

Signed and Sealed this
Third Day of March, 2015

Michelle K. Lee

Michelle K. Lee
*Deputy Director of the United States Patent and Trademark Office*